US005986686A

United States Patent [19]

Guckin

[11] Patent Number: 5,986,686

[45] Date of Patent: Nov. 16, 1999

[54] APPARATUS FOR MAKING GRAPHIC PRODUCTS HAVING A PLATEN DRIVE WITH ENCODED SPROCKETS

[75] Inventor: Mark Guckin, Middletown, Conn.

[73] Assignee: Gerber Scientific Produccts, Inc., Manchester, Conn.

[21] Appl. No.: 08/440,083

[22] Filed: May 12, 1995

[51] Int. Cl.[6] ..... B41J 11/28

[52] U.S. Cl. ..... 347/218; 346/134; 346/136; 346/138

[58] Field of Search ..... 347/215, 218; 346/134, 136, 138; 400/616, 616.1, 616.2, 616.3, 617; 226/2, 3, 24, 27, 28, 36

[56] References Cited

U.S. PATENT DOCUMENTS

| | | | |
|---|---|---|---|
| 3,877,035 | 4/1975 | Miller et al. | 346/49 |
| 3,949,856 | 4/1976 | Ulber et al. | 197/133 |
| 4,228,938 | 10/1980 | Monma et al. | 226/9 |
| 4,445,128 | 4/1984 | Dolan et al. | 346/138 |
| 4,467,525 | 8/1984 | Logan et al. | 33/18 B |
| 4,708,901 | 11/1987 | Wood | 428/131 |
| 4,739,344 | 4/1988 | Sullivan et al. | 346/76 PH |
| 4,768,410 | 9/1988 | Wood | 83/93 |
| 4,811,038 | 3/1989 | Gordan et al. | 346/140 R |
| 4,834,276 | 5/1989 | Logan | 226/76 |
| 4,948,282 | 8/1990 | Koike et al. | 400/616.2 |
| 5,537,135 | 7/1996 | Hevenor et al. . | |

FOREIGN PATENT DOCUMENTS

| | | | |
|---|---|---|---|
| 0 535 932 A2 | 4/1993 | European Pat. Off. | B41J 11/44 |
| 0607539A2 | 11/1993 | European Pat. Off. . | |
| 0 607 539 A2 | 7/1994 | European Pat. Off. | B26F 1/38 |
| 57-2784 | 1/1982 | Japan | B41J 15/16 |
| 57-2785 | 1/1982 | Japan | B41J 15/16 |
| 57-46896 | 3/1982 | Japan | B41J 11/30 |
| A 57002785 | 8/1982 | Japan . | |
| A 58055266 | 1/1983 | Japan . | |
| 58-147757 | 10/1983 | Japan | B41J 11/28 |
| 60-253566 | 5/1984 | Japan . | |
| A 59098881 | 7/1984 | Japan . | |
| 60-23070 | 2/1985 | Japan | B41J 11/42 |
| 60-137757 | 7/1985 | Japan | B65H 29/00 |
| 62-77961 | 4/1987 | Japan | B41J 11/26 |
| 63-246264 | 10/1988 | Japan | B41J 11/26 |
| 1-104555 | 4/1989 | Japan | B65H 20/20 |
| 1-275077 | 11/1989 | Japan | B41J 11/42 |
| 8-183215 | 7/1996 | Japan | B41J 13/02 |
| 592094 | 10/1987 | United Kingdom . | |

OTHER PUBLICATIONS

PCT Application No. PCT/US93/02724 of Summagraphics Corporation on Strip Mode Printing and Plotting Apparatus and Method published Feb. 3, 1994.

European Search Report from the corresponding European application citing the above–listed references.

*Primary Examiner*—Huan Tran

*Attorney, Agent, or Firm*—McCormick, Paulding & Huber

[57] ABSTRACT

A thermal printing apparatus for printing graphic images on sheet material, such as a vinyl sheet, utilizes a platen drive to move the sheet material between a roller platen and thermal print head. The thermal print head presses the sheet material into engagement with the roller platen along a linear zone of contact, and a drive motor is drivingly connected to the roller platen through a series of drive gears to rotatably drive the roller platen, and in turn move the sheet material between the platen and print head. A pair of registration sprockets are mounted on opposite ends of a common sprocket shaft, and engage corresponding feed holes formed in the marginal edges of the sheet material. The registration sprockets guide and steer the sheet material as it is driven between the roller platen and the print head, and substantially prevent buckling or like distortion of the sheet material. A sensor is coupled to the drive shaft, and generates signals indicative of the rotational position and direction of the registration sprockets, and thus indicative of the position of the sheet material relative to the print head. A controller is coupled to the sensor, and selectively energizes the heating elements of the thermal print head in response to the positional signals transmitted by the sensor and image data to accurately print graphic images on the sheet material.

28 Claims, 5 Drawing Sheets

APPARATUS FOR MAKING GRAPHIC PRODUCTS HAVING A PLATEN DRIVE WITH ENCODED SPROCKETS

FIELD OF THE INVENTION

The present invention relates to apparatus for making graphic products on sheet material, and more particularly, to systems for driving and registering the sheet material in such apparatus.

BACKGROUND INFORMATION

One of the most successful systems today for producing sheet material products with multicolored or enhanced graphic images for signs and like displays is the GERBER EDGE™, manufactured by Gerber Scientific Products, Inc. of Manchester, Conn. The GERBER EDGE™ is typically used to print vinyl graphics for signs or like displays, wherein multicolored or enhanced graphic images are printed on a vinyl sheet, and the sheet is cut along the periphery of the graphic images to create a sign or like display. The system uses a thermal print head to print the graphic images on the sheet, and a cutter to cut the sheet along a peripheral edge surrounding the graphic images. The print head and the cutter are controlled by a microprocessor having a common database so that the printed images and the cut edges correspond positionally in the final graphic product.

The vinyl sheet has a series of feed holes along each marginal edge, and is driven over a roller platen mounted below the print head by drive sprockets engaging the feed holes. A removable cassette carrying a donor web bearing transfer ink is mounted adjacent to the print head so that the donor web is interposed between the print head and the vinyl sheet. Heating elements of the print head are selectively energized to transfer ink from the donor web to the vinyl sheet in accordance with commands from the microprocessor to create graphic images on the vinyl sheet. Each cassette carries a donor web bearing a single color of transfer ink, and the cassettes are interchanged to create multicolored images, different shades and/or colors. The drive sprockets and vinyl sheet are slewed back and forth during printing operations to apply the different color transfer inks.

The GERBER EDGE™ system is described in U.S. Pat. No. 5,537,135 entitled "Method And Apparatus For Making A Graphic Product", which is assigned to the Assignee of the present invention, and is hereby expressly incorporated by reference as part of the present disclosure.

A typical ink web is comprised of a resin and/or wax layer containing the transfer ink, a release layer superimposed over the resin/wax layer, a carrier layer superimposed over the release layer, and a back coat superimposed over the carrier layer to provide a low-friction surface for engaging the print head. When the heating elements of the thermal print head are energized, the portions of the resin layer contiguous to the print head undergo transformation from (i) a solid state, to (ii) a semifluid or viscous state, and at the highest temperatures, to (iii) a less viscous, liquid state. Then, as the heating elements are de-energized and upon passage of the ink web and vinyl sheet beyond the print head, the heated portions cool down and return from the liquid, semifluid or viscous states to the solid state, as they approach ambient temperature.

During these changes in physical states, the coefficients of friction and thus the forces transmitted between the vinyl sheet, ink web and print head vary, which leads to variations in the surface velocity of the vinyl, and can in turn cause sagging or like deformation in the vinyl as it passes beneath the print head. Typically, the longer the print head (i.e., the dimension of the print head in the axial direction of the platen), the greater are the variations in the forces applied to the vinyl. Because the vinyl sheet is flexible, the increase in the forces transmitted between the vinyl and print head on each cool-down cycle can cause a lag or positional error between the portions of the vinyl contiguous to the print head and other areas, such as the marginal portions of the vinyl engaging the sprockets. These variations in the vinyl velocity and positional errors lead to fluctuations in image intensity and, concomitantly, a degradation in print quality.

Moreover, because the sprockets are used to positively drive the vinyl, the increase in forces transmitted between the print head and vinyl, causes an increase in the forces transmitted between the sprockets and vinyl, which can in turn lead to deformation of the vinyl's feed holes. Hole deformation can cause shifting of the vinyl, which in turn affects the registration of the image on the vinyl and leads to a degradation in print quality, e.g., color shifts. The registration may change from one pass of the vinyl sheet beneath the print head to the next (pass-to-pass registration) and/or may change upon transfer of the vinyl from the printing apparatus to the vinyl cutting apparatus (print-to-cut registration). Hole deformation typically increases with repeated passes of the vinyl beneath the print head. In addition, the greater the duty cycle in energizing the print head, the more noticeable are these negative effects on print quality.

It is an object of the present invention to overcome the drawbacks and disadvantages of prior art apparatus for making graphic products on sheet material.

SUMMARY OF THE INVENTION

The present invention is directed to an apparatus for making graphic products on sheet material, comprising a roller platen rotatably mounted for supporting and moving the sheet material through the apparatus. A print head for printing graphic images on the sheet material is mounted adjacent to the roller platen, with the sheet material pressed between the print head and roller platen to facilitate engagement of the sheet by the platen. A drive motor is drivingly connected to the roller platen to rotatably drive the platen, and in turn drive the sheet material pressed by the print head against the platen. The apparatus further comprises means for engaging a marginal portion of the sheet material and registering the sheet material with the print head, which is in turn coupled to means for generating signals indicative of the position of the sheet material relative to the print head. A computer control unit is responsive to the positional signals and image data to control operation of the print head to print graphic images on the sheet material.

The sheet material may be a vinyl or like sheet mounted on a releasable backing, which defines a series of feed holes spaced along each marginal edge. The means for engaging preferably includes a pair of registration sprockets mounted to a common sprocket shaft for engaging the feed holes, and in turn guiding and steering the sheet material as it is driven by the roller platen beneath the print head.

The means for generating positional signals preferably includes a sensor such as an encoder, for generating signals indicative of the rotational position of the registration sprockets, and thus indicative of the position of the sheet material relative to the print head. The computer control unit is responsive to the positional signals transmitted by the sensor and image data to selectively energize heating elements of a thermal print head, and thereby accurately print the graphic images on the sheet material.

One advantage of the present invention, is that the registration sprockets or like registration means are not used to directly drive the sheet material, but rather guide or steer the sheet material as it is driven by the roller platen beneath the print head. The roller platen transmits a substantially constant force per unit width to the sheet material to drive the sheet material at a substantially constant velocity across its width, and the registration sprockets or like registration means prevent skewing or otherwise prevent lateral movement of the sheet. As a result, deformation or distortion of the feed holes in the sheet material is substantially avoided, and precise registration of the sheet material with the print head is maintained. In addition, the exact position of the sheet material relative to the print head can be determined based on the position of the registration sprockets or like registration means, thus facilitating precise registration of the sheet material with the print head, and correspondingly enhancing the print quality of the apparatus in comparison to the prior art apparatus described above.

Other advantages of the present invention will become apparent in view of the following detailed description and accompanying drawings.

DETAILED DESCRIPTION OF THE INVENTION

Figure 1:
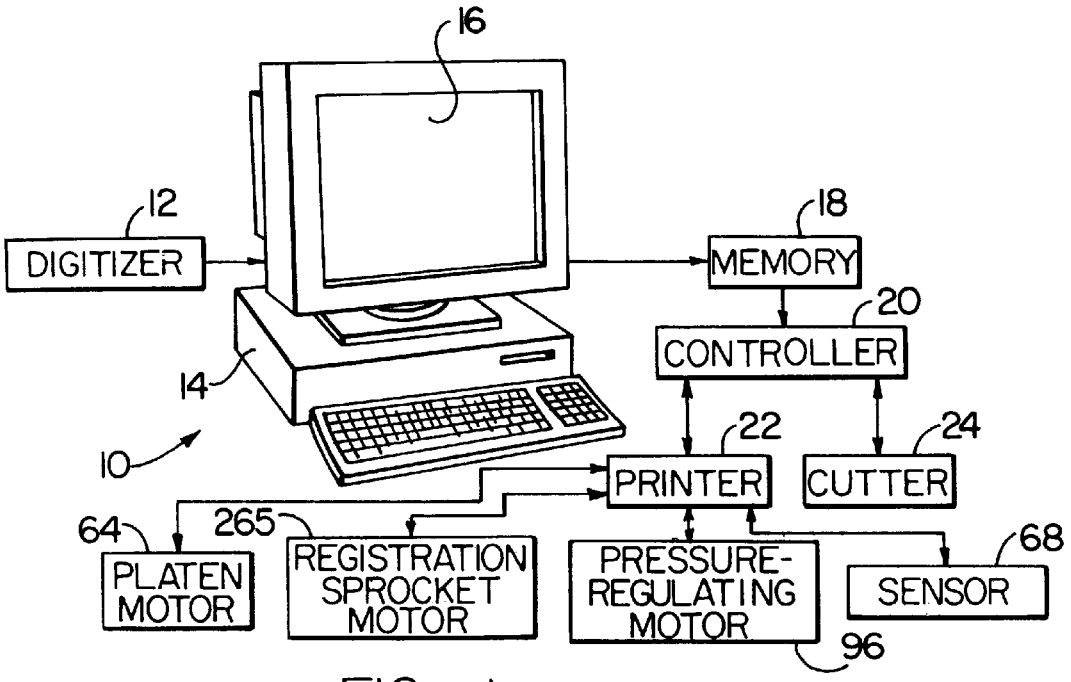
FIG. 1 is a schematic diagram illustrating a system for printing and cutting signs and other graphic products in accordance with the present invention.

In FIG. 1, an apparatus embodying the present invention for making graphic products with multicolored and/or enhanced graphic images is indicated generally by the reference numeral 10. The apparatus of FIG. 1 enables a graphic product to be created and produced from a database within which the printed and cut features of the product are commonly based. The apparatus 10 includes a digitizer 12 or other data input device which transmits data to a computer 14 defining at least the peripheral edges of the graphic product and possibly internal edges as well. The computer 14 displays the data defining the edges as an image on a monitor 16. Then, printing enhancements from a special enhancement program within the computer's memory 18 for creating and printing graphic images are added within the edges of the displayed image as the operator or composer desires by employing a keyboard, mouse and/or like input device. Preferably, all of the edge and enhancement features are referenced to one another in a common database within the computer's memory 18. The enhancement features may include, for example, special programs allowing for halftone images.

Alternatively, the computer's database may include an entire font or halftone or otherwise prepared enhanced characters including the edge data, in which case the data input to the computer 14 may be selected entirely from the database for purposes of preparing a final product. In other cases, the digitizer 12 may serve as the sole input device and may provide the critical data points defining the peripheral edges to be cut as well as the peripheral edges of the graphic images. As will be recognized by those skilled in the pertinent art, other types of data sources may be utilized to supply the computer 14 with an infinite variety of graphic images for creating and producing graphic products with the apparatus 10, such as scanners or compact disks.

From the data defining an enhanced graphic product, the computer 14 generates at least one printing program for operating a controller 20 to control a printing apparatus 22 to print the prepared graphic images on a sheet material. If desired, the computer may also generate a cutting program for operating the controller to control a cutting apparatus 24 to cut the sheet material around the graphic images and create the final graphic product.

In a preferred embodiment of the present invention, the sheet material is a vinyl secured by a pressure-sensitive adhesive on a releasable backing. One such vinyl is sold by the Assignee of the present invention under the trademark SCOTCHCAL™ of the 3M Company. As will be recognized by those skilled in the pertinent art, however, numerous other types of sheet material may equally be employed, such as paper and other types of polymeric sheets, including polyvinyl chloride (PVC) and polycarbonate sheets. Similarly, the sheet material may be supplied in any length on rolls, in flat sheets, or as otherwise desired.

The printing apparatus 22 prints the graphic images on the sheet material, and the printed sheet may be transferred to the cutting apparatus 24 which is operated by the controller 20 to cut the sheet along the peripheral edges of the graphic images and any internal edges, if necessary, in accordance with the cutting program. With the vinyl sheets described above, after weeding to remove unwanted material within or around the printed images, the vinyl forming the enhanced image is lifted from the underlying backing and may be attached to a sign board, window or other object for display.

A suitable cutting apparatus 24 for carrying out the cutting operation on sheets of vinyl or other material is disclosed in U.S. Pat. Nos. 4,467,525, 4,799,172 and 4,834,276, all owned by the Assignee of the present invention.

Figure 2:
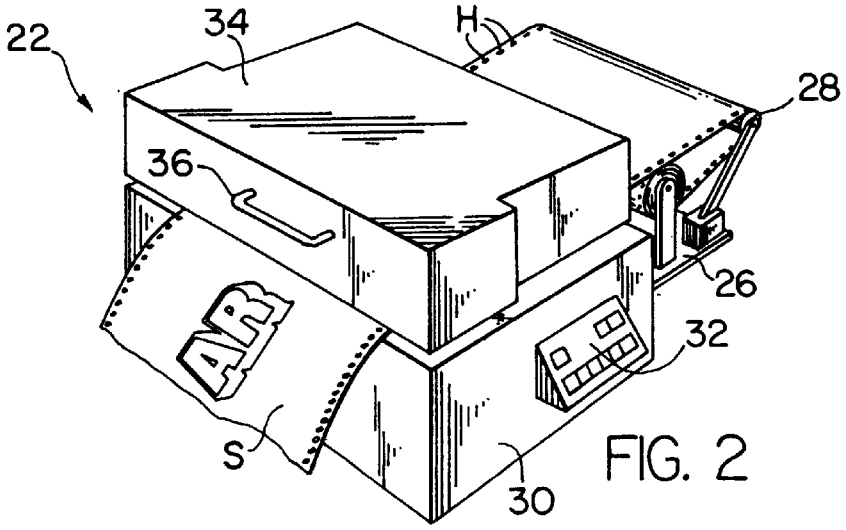
FIG. 2 is a perspective view of a thermal printing apparatus embodying the present invention.

Turning to FIG. 2, a printing apparatus 22 embodying the present invention for carrying out the printing operation utilizes a set of sprockets or other suitable registration means to engage corresponding feed holes H. The feed holes extend along each longitudinal edge of a strip S of sheet material from which the graphic product is prepared, to register and steer the sheet material driven by a roller platen beneath a print head, as is described further below. Correspondingly, the cutting apparatus 24 has a set of sprockets to engage the same series of feed holes H during the cutting operation to likewise register the sheet material with a cutting blade. In this manner the registration of the cut edges of the graphic product with the printed image is insured in the longitudinal direction. Since the graphic image is absolutely fixed both transversely and longitudinally on the strip S relative to the feed holes H, the feed holes become a proper reference for the image in both the printing and cutting operations.

As shown in FIG. 2, the sheet material S is supplied in a roll which may be supported on a platform 26 at the back side of the printing apparatus, and if necessary, may be fed over a guide roller 28 before it enters a housing 30 of the printer. After the sheet S passes through the printer where the printing operation takes place, it is discharged freely at the front side of the apparatus or may be retrieved on a take-up reel if desired.

Although the printer 22 is connected for controlling the printing operation to the controller 20 in FIG. 1, the printer includes a control panel 32 on the housing 30 to, for example, stop and start printing operations. Additionally, the control panel 32 includes controls for slewing the sheet S independently of the printing operation and other controls for operating the printer. As will be recognized by those skilled in the pertinent art, the controller 20 may partially reside in both the printer 22 and computer 14, or may entirely reside in either the printer or computer.

The upper portion of the printer 22 has a cover 34 with a handle 36 that can be opened and closed in order to expose the internal structure of the printer, as shown in FIGS. 3–6.

Figure 3:
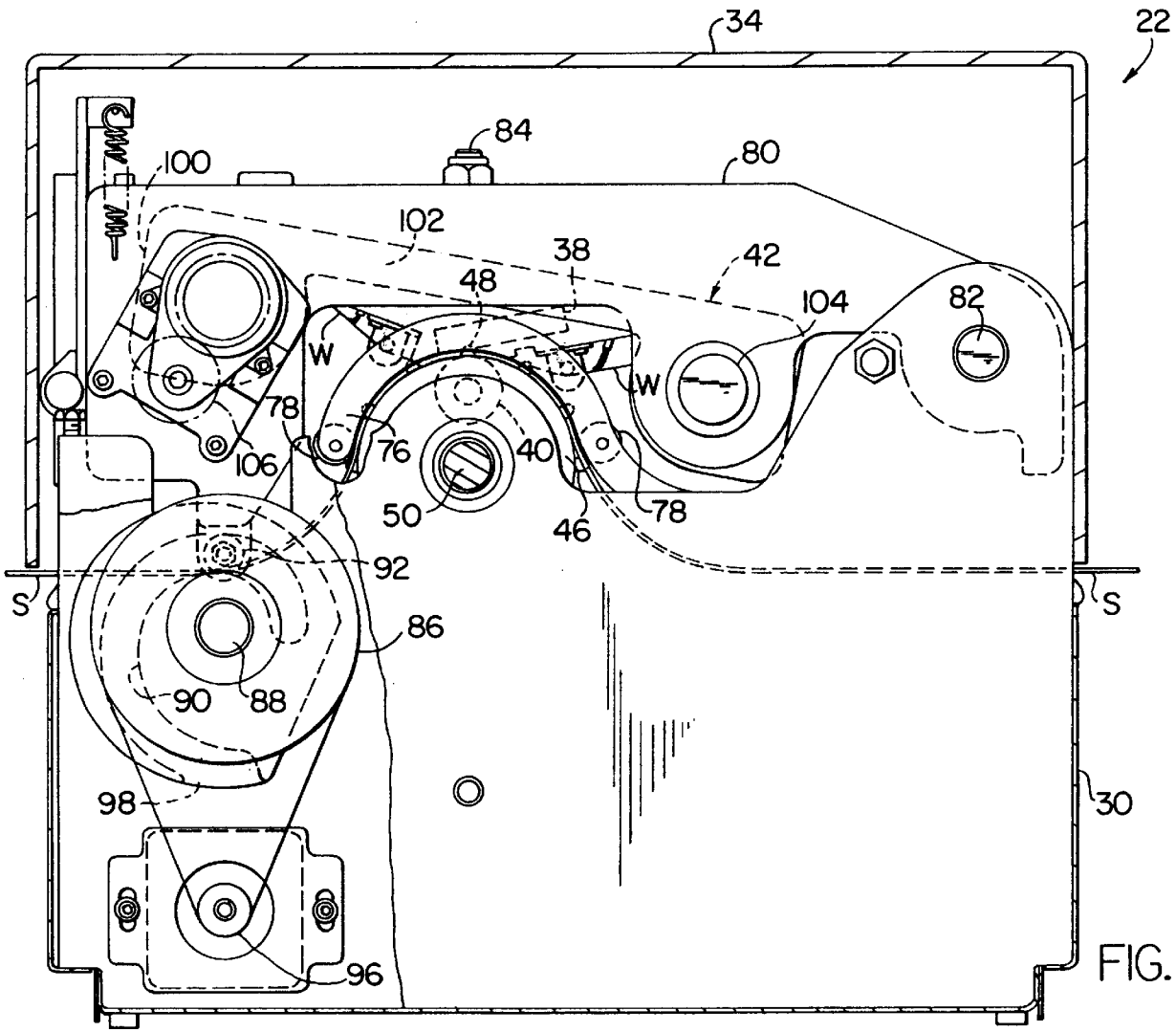
FIG. 3 is a side elevation view of the thermal printing apparatus of FIG. 2 with portions broken away to show the internal structure.

With reference to FIG. 3, the printer includes a thermal print head 38 (shown in hidden lines) mounted on a frame under the cover 34, and a roller platen 40 (also shown in hidden lines) mounted in the housing 30 below the print head for supporting and driving the sheet material S through the printer. A replaceable cassette 42 is installed under the cover 34, and carries a web w bearing the printing ink, which is interposed between the print head 38 and the sheet material S on the roller platen. The thermal print head 38 extends in the axial direction of the roller platen, and is pressed downwardly onto the ink web W and sheet material S to generally establish a linear zone of contact between the ink web, sheet, and roller platen. The print head 38 includes a plurality of heating elements distributed evenly along the head from one end of the roller platen 40 to the other, and the heating elements are densely packed along the line of contact.

As is described further below, during a printing operation, the ink web W and sheet material S are simultaneously driven between the print head 38 and roller platen 40, and the heating elements of the print head are selectively energized so that the portion of the ink immediately beneath each energized heating element is released from the web and transferred to the sheet material. With high density heating elements, graphic images of high resolution are thus created on the strip S of sheet material. The excitation of the heating elements is controlled in accordance with the program of printed material that is read by the controller 20 from the memory 18 of FIG. 1.

Figure 4:
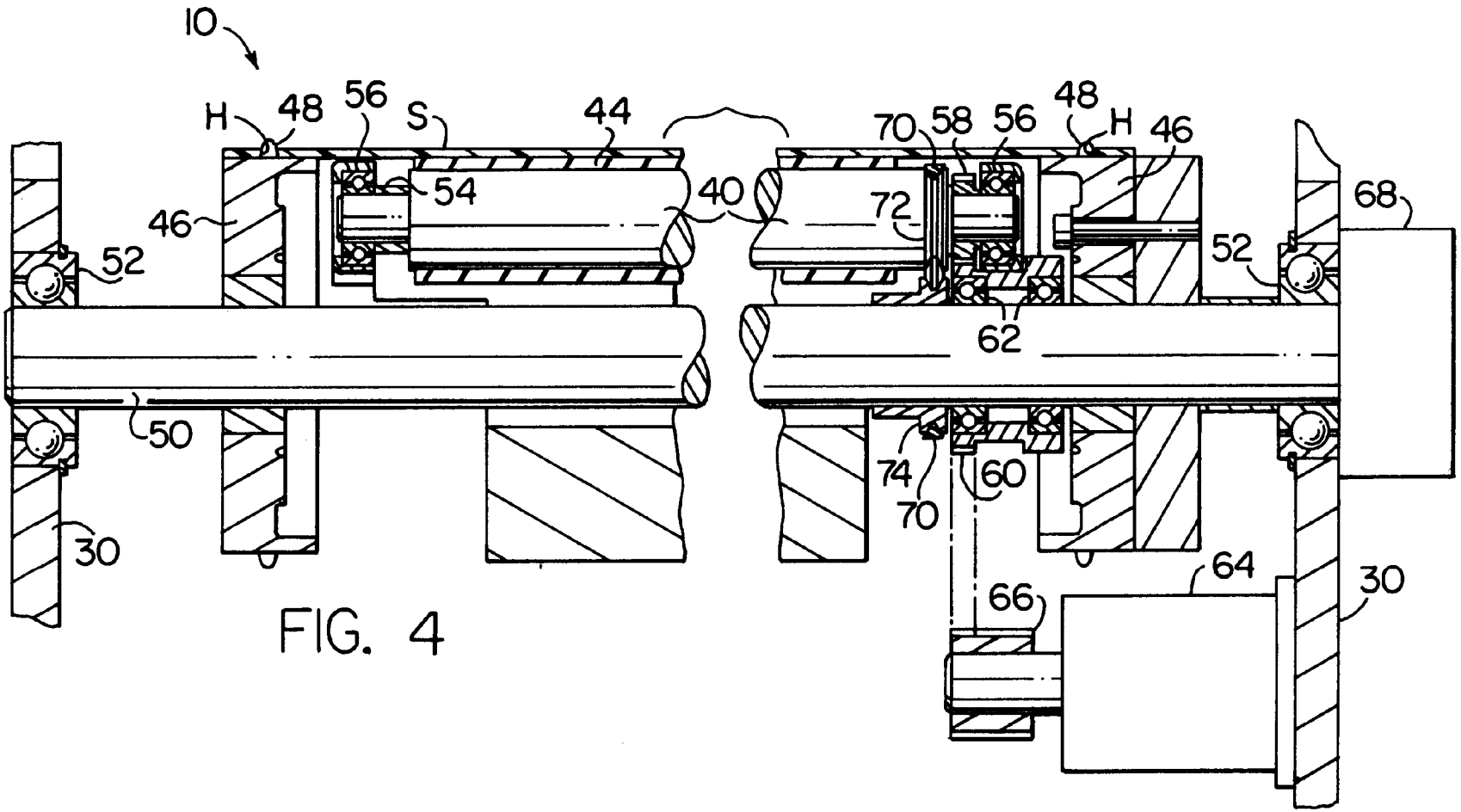
FIG. 4 is a fragmentary front view, in partial cross section of the thermal printing apparatus of FIG. 2 showing the platen drive and encoded sprocket shaft of the present invention.

Turning to FIG. 4, the roller platen 40 includes a hard rubber sleeve 44 for engaging and driving the sheet material S. The polymeric material of the sleeve 44 is selected to provide a firm surface to support the sheet material S beneath the print head, and to enhance the frictional engagement of the platen with the backing of the strip to effectively drive the strip. A marginal edge portion of the sheet material S overlaps the rubber sleeve 44 of the roller platen at each end and is engaged by a respective registration sprocket 46. Each registration sprocket 46 includes a plurality sprocket pins 48, which are received within the feed holes H of the sheet material to guide and steer the sheet, and precisely maintain registration of the sheet as it is driven by the roller platen beneath the print head.

As also shown in FIG. 4, the registration sprockets 46 are each mounted to a common sprocket shaft 50, which is in turn rotatably mounted on each end to the housing 30 by a respective bearing assembly 52. Each registration sprocket 46 is fixed to the shaft 50 in its rotational direction so that the sprockets rotate in sync with each other and the shaft, but may be slidably mounted in the axial direction of the shaft to permit lateral adjustment of the sprockets to accommodate sheet materials of different width.

The roller platen 40 is spaced adjacent and oriented parallel to the sprocket shaft 50, and is mounted on a drive shaft 54, which is in turn rotatably mounted by bearing assemblies 56 to the housing 30. A platen drive gear 58 is fixedly mounted on one end of the platen drive shaft 54, and is meshed with an idler gear 60 rotatably mounted to the sprocket shaft 50 by bearing assemblies 62. A platen drive motor 64, which may be, for example, a step motor, is mounted to the housing 30, and includes a motor drive gear 66 drivingly connected by a suitable gear train, as indicated in phantom, to the idler gear 60. Actuation of the drive motor 64 rotatably drives the idler gear 60, and in turn directly drives the platen drive gear 58 and roller platen 40. As will be recognized by those skilled in the pertinent art, other suitable means may be employed to drivingly connect the platen drive motor to the roller platen, such as a drive belt.

Accordingly, the sheet material S and ink web W are pressed against the roller platen 40 by the print head 38 along substantially the entire length of the platen, and are directly driven by the platen drive motor and roller platen. The registration sprockets 46, on the other hand, do not drive the sheet material during printing operations as in the prior art apparatus described above, but rather engage the feed holes H to guide and steer the sheet material, and in turn prevent skewing of the sheet material under the driving force of the platen, and maintain precise registration of the sheet with the print head.

One advantage of the present invention is that the platen drive applies a substantially constant force per unit width to the sheet material. This is particularly advantageous with wider sheet material, for example, greater than 15 inches. The wider the sheet material, the more prone it is to buckling or like distortion in response to the application of an uneven driving force, which can in turn lead to a degradation in print quality. This is also particularly advantageous during printing operations when the ink web is subjected to heating and cooling cycles, which cause fluctuations in the forces transmitted between the print head, ink web and vinyl sheet, and in the prior art apparatus, has lead to buckling or like distortion of the vinyl sheet. The substantially constant force per unit width applied by the platen drive of the present invention can overcome these problems and drive the sheet material at a substantially constant velocity across its width.

Yet another advantage of the present invention is that the registration sprockets effectively steer the sheet material and substantially prevent skewing or other lateral movement of the sheet as it is driven between the roller platen and print head. In the preferred embodiment, it is particularly advantageous that the registration sprockets are both mounted to the same sprocket shaft, and are mounted on opposite ends of, and aligned with the linear zone of contact of the print head. As discussed above, the registration sprockets engage the marginal portions of the sheet material, on opposite sides of the sheet material at points substantially aligned with the linear zone of contact of the print head. As a result, only relatively slight forces are transmitted between the sprocket pins and feed holes to counteract potentially distorting or skewing forces applied between the platen and/or print head and sheet material. This substantially prevents distortion of the feed holes, and in turn maintains precise registration of the sheet material with the print head, as hereinafter described.

As shown in FIG. 4, an sensor 68 is mounted to the housing 30 adjacent to the sprocket shaft 50 to track the rotational position of the registration sprockets 46 and thus the position of the sheet material S engaged by the sprockets. As shown in FIG. 1, the sensor 68 is coupled to the controller 20 and transmits signals to a register in the controller indicative of the rotational direction and position of the sprocket shaft 50, and thus of the rotational direction and position of the registration sprockets 46 mounted to the shaft. As will be recognized by those skilled in the pertinent art, any of numerous known types of sensors may be employed as the sensor 68, including, for example, a suitable resolver or encoder, such as an optical encoder, for encoding the registration sprockets or sprocket shaft and generating signals indicative of their rotational direction and position.

Because the apparatus of the present invention prevents distortion of the feed holes H of the sheet material, as described above, the sensor signals are also indicative of the precise position of the sheet material S relative to the print head. Accordingly, the controller 20 selectively energizes the heating elements of the print head in accordance with the printing program in response to the positional signals transmitted by the sensor coupled with the image data. Because the feed holes H maintain precise registration of the sheet material with the print head, and the positional signals transmitted by the sensor 68 are based on the position of the sprockets engaging the feed holes, the graphic images are accurately printed on the sheet material in accordance with the printing program, and the printing quality is correspondingly enhanced in comparison to prior art apparatus.

During printing operations, if the registration sprockets and shaft assembly are permitted to rotate as the sheet material is driven by the roller platen, it is unnecessary to positively drive the sprockets to effectively guide and prevent skewing of the sheet material. If, on the other hand, the sprockets and shaft assembly are not permitted to rotate or if they otherwise would impose a dragging force on the sheet material, it may be necessary to drive the sprockets, not for purposes of driving the sheet material (which can lead to hole distortion), but to prevent the sprockets from dragging or otherwise inhibiting the movement of the sheet material in its longitudinal direction. It may also be desirable to drive the sprockets during non-printing operations when the print head 38 is spaced away from the roller platen 40 (thus preventing the roller platen from driving the sheet material), in order to slew the sheet material back and forth over the roller platen quickly.

Accordingly, in the embodiment of the invention illustrated in FIG. 4, in order to slew the sheet material S during non-printing operations, and to prevent the sprockets 46 from imposing a dragging force or from otherwise inhibiting the movement of the sheet material in its longitudinal direction during printing operations, the sprocket shaft 50 and registration sprockets 46 may be tangentially driven from the platen drive shaft 54 by a drive belt 70. As shown in FIG. 4, the drive belt 70 is a v-belt, which is coupled between a first pulley 72 fixedly mounted to the platen drive shaft 54 and a second pulley 74 fixedly mounted to the sprocket shaft 50. The drive belt 70 preferably permits a limited slip between the belt and both the sprocket and platen shafts. Although a v-belt is illustrated, any of numerous known drive belts or other suitable drive train permitting limited slip may be employed. Accordingly, actuation of the platen drive motor 64 directly drives the platen drive shaft 54, which in turn tangentially drives the belt 70 and sprocket shaft 50 to move the registration sprockets 46 synchronously with the strip S.

During non-printing operations, when the print head 38 is spaced away from the roller platen 40, the sheet material S may be slewed back and forth over the roller platen by rotatably driving the platen drive shaft 54 and drive belt 70, which in turn drives the registration sprockets 46 and sheet material S. In this mode, the print head 38 is spaced away from the roller platen 40, and there is therefore insignificant resistance to movement of the sheet material in its longitudinal direction. Accordingly, only relatively slight forces are transmitted between the sprocket pins 48 and feed holes H as the sheet material S is slewed back and forth over the roller platen, thus maintaining the integrity of the feed holes and precise registration of the sheet material with the print head. If, on the other hand, the sheet material becomes jammed or a more significant resistance otherwise counteracts the slewing of the sheet material, the drive belt 70 permits slippage between the belt and both the sprocket and the platen shaft to prevent deformation of the feed holes.

During printing operations, on the other hand, when the print head 38 is pressed into engagement with the ink web W and sheet material S, the web and sheet are directly driven by the roller platen, as described above. In this mode, the drive belt 70 tangentially drives the sprocket shaft 50 so that the sprockets 46 move along or keep up with the sheet material S and thereby do not present a drag. Because slippage is permitted between the drive belt 70 and both the sprocket and roller platen shafts, the driving force applied by the sprocket pins 48 to the feed holes H is insufficient to create hole distortion or to otherwise unfavorably affect registration of the sheet material with the print head.

Turning again to FIG. 3, in order to keep the sheet material S fully engaged with approximately 180° of the registration sprockets 46, a pair of holddown bails 76 (only one shown) straddle the pins 48 of each sprocket. The bails are pivotally suspended from the housing 30 on pins (not shown) so that the bails can be lifted away from the sprockets and allow a strip of sheet material S to be mounted on and removed from the sprocket and roller platen 40. Over-center springs (not shown) are preferably used to hold each bail 76 downwardly on the strip S and also permit lifting of the bails away from the sprockets during installation or removal of a strip. In addition, a pair of holddown rollers 78 extend between the bails 76 at the supply and discharge points of the roller platen 40. Thus, the feed holes H along each marginal edge of the sheet material S are threaded onto the sprockets 46 by lifting the bails, and are held firmly with the sprockets by lowering the bails to maintain accurate registration of the sheet material with the print head.

As also shown in FIG. 3, the thermal print head 38 is mounted in an upper support frame 80, which is pivotally mounted on an axle 82 at the backside of the housing 30. Accordingly, the upper support frame 80 and print head 38 are pivoted toward and away from the roller platen upon closing and opening the cover 34 of the printing apparatus, respectively. The details as to how the print head 38 is mounted and suspended from the support frame are illustrated and described in the above-mentioned U.S. Pat. No. 5,537,135. Briefly, however, the print head 38 is mounted by a suspension plate (not shown) to the support frame 80 by a series of bolts 84, shown typically in FIG. 3, and a plurality of coil springs (not shown) each surround a respective bolt 84 and are interposed between the suspension plate and the support frame 80. The coil springs apply a pressure downwardly against the suspension plate, and in turn press the print head 38 against the strip S of sheet material and the roller platen 40 along a linear zone of contact. As described above, the heating elements of the print head 38 are densely packed along the line of contact, and are selectively energized to transfer the ink from the web W to the sheet material S.

In order to regulate the amount of pressure applied to the ink web W and sheet material S by the print head and roller platen, the projecting or cantilevered end of the support frame 80 is moved up and down relative to the roller platen 40 by a pressure-regulating mechanism that is adjusted by the controller 20. As shown in FIG. 3, the pressure-regulating mechanism includes a cam 86 rotatably mounted in the housing 30 on a shaft 88. The cam 86 defines a spiral cam slot 90 (shown in hidden lines) which receives and engages a cam follower 92 (also shown in hidden lines) connected to the projecting end of the support frame 80. The cam 86 is coupled by a toothed drive belt 94 to a pressure-regulating step motor 96. Accordingly, as the cam 86 is rotated by the pressure-regulating step motor 96, the relative movement of the cam follower 92 within the cam slot 90 causes the support frame 80 and print head 38 to move up or down, depending upon the direction of rotation of the cam, and thereby adjust the pressure applied to the ink web W and sheet material S between the print head 38 and roller platen 40. The pressure-regulating motor 96 is coupled to the controller 20, which in turn controls rotation of the cam 86 to precisely set the pressure applied to the ink web and sheet material.

As also shown in hidden lines in FIG. 3, the cam slot 90 defines an exit point 98 at the periphery of the cam 86, so that the cam follower and correspondingly the support frame 80 can be lifted completely free of the cam when the controller 20 controls rotation of the cam to its upright position. The controller 20 also controls the position of the cam 86 to move the print head 38 into and out of contact with the ink web W and sheet material S. For example, at the end of a printing operation, or between application of different colored inks, the controller 20 controls operation of the pressure-regulating motor 96 to drive the cam 98 to a position at which there is zero pressure between the print head and roller platen. In addition, the print head 38 can be lifted away from the roller platen 40 so that the sheet material S can be slewed back and forth relative to the print head without making contact with the web W of printing ink.

As will also be recognized by those skilled in the pertinent art, the pressure-regulating motor 96 may be adjusted by the controller 20 in accordance with numerous printing parameters. For example, the pressure may be adjusted to affect the transfer of ink from the web to the sheet material depending upon the type of sheet material and/or ink web employed. The pressure may likewise be adjusted to affect the force transmitted between the drive platen and the sheet material, or to affect the intensity or tone of the printed images. Accordingly, the adjustment of the pressure level can occur prior to or throughout a printing operation in accordance with print characteristics that are stored in the print program or are measured during a printing operation.

As mentioned above, the cassette 42 carrying the ink web W is replaceable, and is shown in the installed position in FIG. 3. A preferred construction of the cassette and the mechanism for mounting the cassette to the support frame 80 are illustrated and described in detail in the above-mentioned U.S. Pat. No. 5,537,135. Briefly, however, each cassette 42 is easily installed and removed from the frame 80 when the frame and cover 34 are lifted to a fully-open position to, for example, replace a depleted cassette or select a different ink for printing.

As shown partially in hidden lines in FIG. 3, each cassette 42 comprises two end shells 100 and two molded side rails 102 extending between the end shells and defining a generally rectangular configuration with an opening in the center. The ink web W is attached on each end to spools (not shown) rotatably mounted and enclosed within each end shell 100, and the ink web is passed from one spool to the other through the central opening in the cassette. As also shown in FIG. 3, the print head 38 passes downwardly into the central opening of the cassette 42 and presses the ink web W onto the sheet material S along the linear zone of contact. A slip clutch or drag brake 104 is coupled to the supply spool of the cassette 42 to impose a frictional restraint on the spool as the ink web W is pulled off the spool.

As also shown in FIG. 3, a web drive motor 106 is coupled through a slip clutch (not shown) to the opposite or take-up spool of the cassette 42. The drive motor 106 is coupled to the controller 20, and when engaged it applies a torque to the take-up spool, and thus produces a uniform tension force on the ink web W. The web drive motor 106 is engaged only during printing operations, and the force applied to the ink web is limited by the slip clutch (not shown) so that the actual movement of the web is controlled by movement of the roller platen 40. Accordingly, the web W and sheet material S are pressed between the print head 38 and roller platen 40 and move synchronously relative to the print head during printing operations. During non-printing operations, on the other hand, the controller 20 relieves the pressure applied by the print head and de-energizes the web drive motor 106 so that when the sheet material S is slewed, the ink web neither moves, nor is it consumed.

Figure 5:
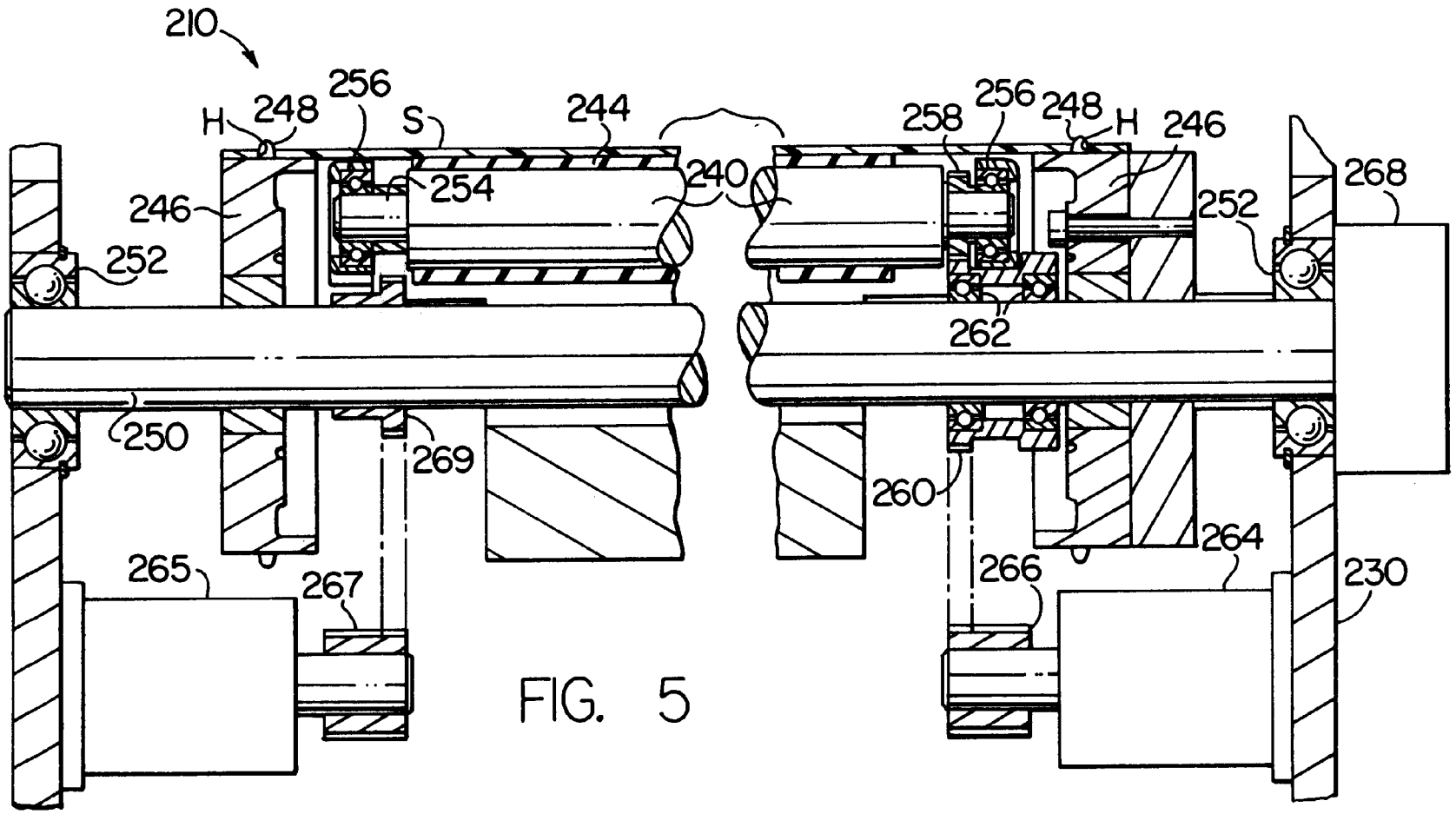
FIG. 5 is a fragmentary front view, in partial cross section of another embodiment of the platen drive and encoded sprocket shaft of the present invention.

Turning to FIG. 5, another embodiment of the present invention is indicated generally by the reference numeral 210. The apparatus 210 is identical in many respects to the apparatus 10 described above, and therefore like reference numerals preceded by the numeral 2 are used to indicate like elements. The primary difference of this embodiment in comparison to the first embodiment is that the sprocket shaft 250 and sprockets 246 are not tangentially driven by the roller platen 240, but rather are independently driven by a sprocket drive motor 265. The sprocket motor 265 is coupled to the controller 220 (not shown), and includes a drive gear 267 drivingly connected through a suitable gear train, as indicated in phantom, to a sprocket gear 269 keyed to the sprocket shaft 250. Accordingly, actuation of the sprocket drive motor 265 rotatably drives the sprocket shaft 250 and sprockets 246 independently of the roller platen 240.

During non-printing operations when the print head is spaced away from the roller platen, the controller 220 controls the sprocket drive motor 265 to slew the sheet material S over the roller platen. During printing operations, on the other hand, the sheet material S and ink web W are driven by the roller platen 240, as described above. Also in the printing mode, the sprocket drive motor may be actuated to move the sprockets with the strip S and thereby prevent the application of a dragging force on the strip that might otherwise cause distortion of the feed holes H. Alternatively, the sprocket drive motor may be shut down during printing operations to permit the sprockets to rotate freely as the roller platen drives the sheet material relative to the print head. If the sprocket drive motor is a positional motor, e.g., a step motor, it should be employed with a slip clutch coupled between the motor and the sprocket shaft to control the torque applied to the shaft. Accordingly, during printing operations the clutch may be controlled to permit limited slippage between the motor and the shaft, and thereby prevent the sprocket drive motor from counteracting or otherwise interfering with the driving action of the roller platen. Alternatively, the sprocket drive motor may be a torque motor, which would likewise permit control of the torque applied to the sprocket shaft to prevent deformation or distortion of the feed holes in the sheet material.

Figure 6:
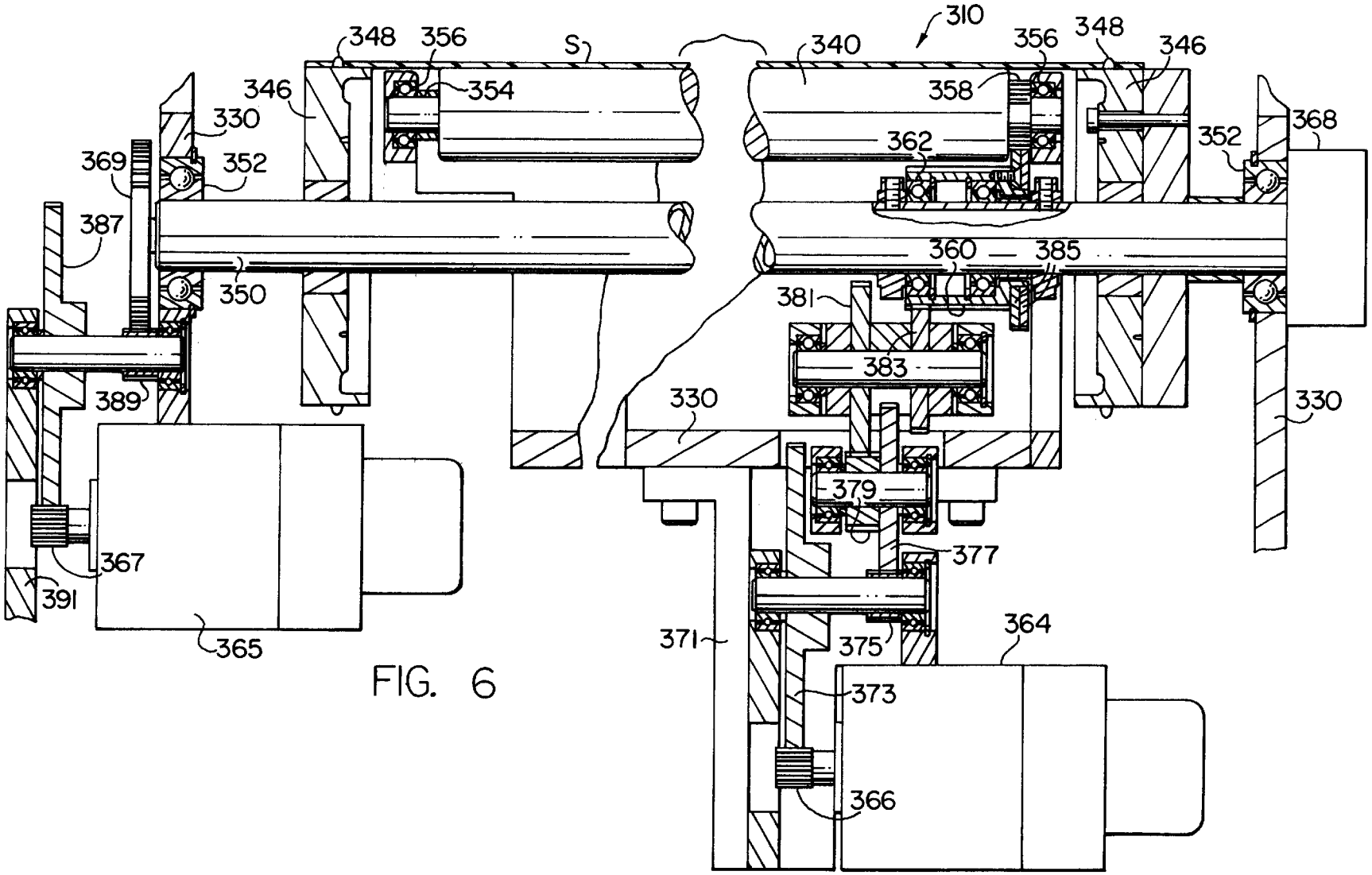
FIG. 6 is a fragmentary front view, in partial cross section of another embodiment of the platen drive and encoded sprocket shaft of the present invention.

Turning to FIG. 6, another embodiment of the present invention is indicated generally by the reference numeral 310. The apparatus 310 is the same in many respect as the apparatus 210 described above with reference to FIG. 5, and therefore like reference numerals preceded by the numeral 3 instead of the numeral 2 are used to indicate like elements. The primary difference between the embodiment of FIG. 6 and that of FIG. 5, is that FIG. 6 illustrates a preferred platen gear train coupled between the platen drive motor 364 and platen drive shaft 354, and a sprocket gear train coupled between the sprocket drive motor 365 and sprocket shaft 350.

As shown in FIG. 6, the platen drive motor 364 is carried by a motor mount 371 fixedly mounted to the housing 330. The motor drive gear 366 is meshed with a first gear 373 of the platen gear train, which is coupled through a rotatably-mounted shaft to a second gear 375. The second gear 375 is meshed with a third gear 377 coupled through a rotatably-mounted shaft to a fourth gear 379, which is in turn meshed with a fifth gear 381. The fifth gear 381 is coupled through another rotatably-mounted shaft to a sixth gear 383, which is in turn meshed with the idler gear 360 rotatably mounted to the sprocket shaft 350 by the bearing assemblies 362. A pair of backlash gears 385 are keyed to the idler gear 360 and meshed with the platen drive gear 358 to eliminate backlash between the roller platen and gear train. Accordingly, actuation of the platen drive motor 364 directly drives the roller platen 340 through the gear train, to in turn drive the sheet material S beneath the print head.

As also shown in FIG. 6, the sprocket drive motor 365 is mounted to the housing 330, and the sprocket drive gear 367 is coupled to a first gear 387 of the sprocket gear train. The first gear 387 is coupled to a second gear 389 through a rotatably-mounted shaft supported between the housing 330 and a cover plate 391 mounted to an outside wall of the housing. The second gear 389 is in turn meshed with the sprocket gear 369 keyed to the end of the sprocket shaft 350. As with the embodiment of FIG. 5, if the sprocket drive motor is a positional motor, such as a step motor, it should be coupled through a slip clutch (not shown) to the sprocket drive train to control the torque and prevent the sprocket motor from counteracting or otherwise interfering with the driving action of the roller platen during printing operations. In addition, suitable gear boxes may be employed in place of the illustrated platen and/or sprocket gear trains to provide equivalent gear ratios.

As will be recognized by those skilled in the pertinent art, instead of the registration sprockets and/or feed holes formed in the sheet material, another suitable type of registration unit or like means may be employed for engaging the marginal portions of the sheet material and registering the sheet material with the print head. For example, a tractor-type feed mechanism may be employed instead of the registration sprockets to engage suitable feed holes and register and steer the sheet material upon passage between the roller platen and print head. Similarly, opposed friction rollers or friction wheels may be employed instead of the registration sprockets to frictionally engage the marginal edges of the sheet material and register and steer the same upon passage beneath the print head. One such system may employ two pairs of opposed rollers located on opposite ends of the roller platen in line with the print head, wherein each pair frictionally engages the front and back surfaces of a respective marginal edge of the sheet material to grip the edges, and thereby guide and steer the sheet material. The positional sensor may similarly be coupled to the tractor-feed, friction rollers, wheels or like registration unit to generate the positional and directional signals for controlling the print head.

In addition, the platen drive system of the invention is particularly suitable for printing graphic images on relatively large-width sheets, wherein a thermal print head is moveable in the axial direction of the roller platen to print throughout the lateral width of the sheet. It may also be desirable to add one or more platen drive rollers on, for example, either side of the roller platen described above. If necessary, a capstan or pinch roller may be mounted above each additional platen drive roller to press the sheet material against the drive rollers.

Numerous changes and/or additions may therefore be made to the above-described and other embodiments of the present invention without departing from the scope of the invention as defined in the appended claims. Accordingly, the invention has been described and illustrated herein in an illustrative, as opposed to a limiting sense.

What is claimed is:

1. An apparatus for printing graphic products on sheet material, comprising:

a roller platen rotatably mounted for supporting and moving a sheet material;

a print head for printing graphic images on the sheet material, the print head being mounted adjacent to the roller platen with the sheet material pressed between the print head and roller platen to facilitate engagement of the sheet material by the roller platen;

means for driving the roller platen during printing operations for driving the sheet material between the roller platen and print head;

two registration units rotatably mounted at opposite ends of the roller platen relative to each other and engageable with opposing marginal portions of the sheet material; and means for interlocking the two registration units for rotation in unison with each other and relative to the roller platen to thereby guide and register the sheet material with the print head.

2. An apparatus as defined in claim 1, further comprising:

means for generating signals indicative of the position of the sheet material relative to the print head; and means responsive to the signals for controlling the print head for printing graphic images on the sheet material.

3. An apparatus as defined in claim 1, wherein the sheet material defines a plurality of holes spaced relative to each other in opposed marginal portions thereof, and the two registration units comprise two registration sprockets engaging the holes of the sheet material to register and steer the sheet material upon passage between the roller platen and print head.

4. An apparatus as defined in claim 3, wherein the print head defines a substantially linear zone of contact with the sheet material, and the two registration sprockets are mounted on opposite ends of, and substantially aligned with the linear zone of contact.

5. An apparatus as defined in claim 1, wherein the means for interlocking the two registration units comprises a shaft and the two registration units are fixedly connected to the shaft.

6. An apparatus for printing graphic products on sheet material, comprising:

a roller platen rotatable mounted for supporting and moving a sheet material;

a print head for printing graphic images on the sheet material, the print head being mounted adjacent to the roller platen with the sheet material pressed between the print head and roller platen to facilitate engagement of the sheet material by the roller platen;

means for driving the roller platen during printing operations for driving the sheet material between the roller platen and print head;

means for engaging a marginal portion of the sheet material and registering the sheet material with the print head; and means for driving the sheet material over the roller platen during non-printing operations.

7. An apparatus as defined in claim 6, wherein the means for driving the sheet material during non-printing operations includes a drive belt coupled and permitting slippage between the roller platen and the means for engaging and registering a marginal portion of the sheet material.

8. An apparatus as defined in claim 6, wherein the means for driving the sheet material during non-printing operations includes a drive motor coupled to the means for engaging and registering to rotatably drive the means for engaging and in turn drive the sheet material.

9. An apparatus as defined in claim 8, further comprising means for permitting slippage between the drive motor and the means for engaging and registering to prevent damaging the marginal portion of the sheet material.

10. An apparatus for printing graphic products on sheet material, comprising:

a roller platen rotatably mounted for supporting and moving a sheet material;

a print head for printing graphic images on the sheet material, the print head being mounted adjacent to the roller platen with the sheet material pressed between the print head and roller platen to facilitate engagement of the sheet material by the roller platen;

first means for driving the roller platen for moving the sheet material between the roller platen and print head during printing operations;

second means for engaging a marginal portion of the sheet material and registering the sheet material with the print head;

third means coupled to the second means for generating signals indicative of the position of the sheet material relative to the print head; and fourth means responsive to the signals for controlling the print head for printing graphic images on the sheet material.

11. An apparatus as defined in claim 10, wherein the sheet material defines a plurality of apertures spaced along at least one marginal portion thereof, and the second means includes at least one registration sprocket rotatably mounted adjacent to the sheet material and engaging the apertures to register the sheet material with the print head.

12. An apparatus as defined in claim 11, wherein the second means includes two registration sprockets mounted on a common sprocket shaft, each registration sprocket engaging apertures defined in a respective marginal portion of the sheet material to register the sheet material with the print head and steer the sheet material upon passage between the print head and roller platen.

13. An apparatus as defined in claim 11, wherein the third means includes an encoder generating signals indicative of the rotational position of the at least one registration sprocket and thus of the sheet material relative to the print head.

14. An apparatus as defined in claim 10, wherein the first means includes a first motor coupled to the roller platen for driving the roller platen and sheet material during printing operations, and the apparatus further comprises a second motor coupled to the second means to rotatably drive the second means, and in turn drive the sheet material over the roller platen during non-printing operations.

15. An apparatus as defined in claim 14, further comprising means for controlling the torque applied by the second motor to the second means for preventing distortion of the marginal portion of the sheet material.

16. An apparatus as defined in claim 10, further comprising a drive belt coupled between the roller platen and the second means to rotatably drive the second means, and in turn drive the sheet material over the roller platen during non-printing operations.

17. An apparatus for printing graphic products on sheet material, comprising:

a roller platen rotatably mounted for supporting and moving the sheet material;

a print head for printing graphic images on the sheet material, the print head being mounted adjacent to the roller platen for pressing the sheet material between the print head and roller platen to facilitate engagement of the sheet material by the roller platen;

a drive motor drivingly connected to the roller platen for rotatably driving the roller platen and in turn moving the sheet material between the print head and roller platen during printing operations;

at least one registration unit rotatably mounted adjacent to the sheet material and engaging a respective marginal portion of the sheet material to register the sheet material with the print head; and a sensor generating signals indicative of the rotational position of the at least one registration unit and of the sheet material relative to the print head.

18. An apparatus as defined in claim 17, wherein the sheet material defines a plurality of apertures spaced along at least one marginal portion thereof, and the at least one registration unit engages the apertures to register the sheet material with the print head.

19. An apparatus as defined in claim 18, wherein the at least one registration unit comprises a registration sprocket including a plurality of sprocket pins engaging the apertures in the sheet material.

20. An apparatus as defined in claim 19, wherein the sheet material defines a plurality of apertures spaced along opposing marginal portions thereof, and the apparatus comprises two registration sprockets mounted on a common sprocket shaft, each registration sprocket engaging apertures defined in a respective marginal portion of the sheet material to register the sheet material with the print head and steer the sheet material upon passage between the print head and roller platen.

21. An apparatus as defined in claim 20, wherein the print head defines a substantially linear zone of contact with the sheet material, and the two registration sprockets are mounted on opposite ends of, and substantially aligned with the linear zone of contact.

22. An apparatus as defined in claim 17, further comprising means for driving the sheet material over the roller platen during non-printing operations.

23. An apparatus as defined in claim 22, wherein the means for driving the sheet material during non-printing operations includes a drive belt coupled and permitting slippage between the roller platen and the at least one registration unit.

24. An apparatus as defined in claim 22, wherein the means for driving the sheet material during non-printing operations includes a second drive motor drivingly connected to the at least one registration unit to rotatably drive the at least one registration unit and in turn drive the sheet material engaged by the registration unit over the roller platen during non-printing operations.

25. An apparatus as defined in claim 24, further comprising means for adjusting the torque transmitted by the second drive motor to prevent deformation of the marginal portion of the sheet material engaged by the registration unit.

26. An apparatus as defined in claim 17, wherein the print head is a thermal print head establishing a generally linear zone of contact with the sheet material.

27. An apparatus for printing graphic products on sheet material, comprising:

a roller platen rotatably mounted for supporting and moving a sheet material;

means for printing graphic images on the sheet material, including means for pressing the sheet material against the roller platen to facilitate engagement of the sheet material by the roller platen;

first means for driving the roller platen for moving the sheet material between the roller platen and the pressing means during printing operations;

second means for engaging a marginal portion of the sheet material and registering the sheet material with the printing means;

third means coupled to the second means for generating signals indicative of the position of the sheet material relative to the printing means; and fourth means responsive to the signals for controlling the printing means for printing graphic images on the sheet material.

28. An apparatus for printing graphic products on sheet materials, comprising:

a roller platen rotatably mounted for supporting and moving a sheet material;

a print head for printing graphic images on the sheet material, the print head being mounted adjacent to the roller platen with the sheet material pressed between the print head and roller platen to facilitate engagement of the sheet material by the roller platen;

means for driving the roller platen during printing operations for driving the sheet material between the roller platen and print head;

means for engaging a marginal portion of the sheet material and registering the sheet material with the print head;

means for generating signals indicative of the position of the sheet material relative to the print head; and means responsive to the signals for controlling the print head for printing graphic images on the sheet material;

wherein the means for engaging and registering includes at least one registration sprocket engaging feed holes in a marginal portion of the sheet material, and the means for generating signals includes a sensor generating signals indicative of the rotational position of the at least one registration sprocket.

* * * * *